US012582235B2

(12) United States Patent
Rodriguez

(10) Patent No.: US 12,582,235 B2
(45) Date of Patent: Mar. 24, 2026

(54) CANOPIED FOLDING CHAIR ASSEMBLY

(71) Applicant: Javier Rodriguez, San Marcos, CA (US)

(72) Inventor: Javier Rodriguez, San Marcos, CA (US)

( * ) Notice: Subject to any disclaimer, the term of this patent is extended or adjusted under 35 U.S.C. 154(b) by 172 days.

(21) Appl. No.: 18/526,113

(22) Filed: Dec. 1, 2023

(65) Prior Publication Data

US 2025/0176727 A1 Jun. 5, 2025

(51) Int. Cl.

| | |
|---|---|
| ***A47C 4/28*** | (2006.01) |
| ***A47C 4/52*** | (2006.01) |
| ***A47C 7/66*** | (2006.01) |
| ***A47D 1/02*** | (2006.01) |
| ***A47D 13/10*** | (2006.01) |

(52) U.S. Cl.
CPC ..... *A47C 7/666* (2018.08); *A47C 4/28* (2013.01); *A47C 4/52* (2013.01); *A47D 1/02* (2013.01); *A47D 13/107* (2013.01)

(58) Field of Classification Search
CPC ..... A47C 4/28; A47D 1/02; A47D 13/107
See application file for complete search history.

(56) References Cited

U.S. PATENT DOCUMENTS 2,243,984 A * 6/1941 Singewald ..... A47C 1/143 135/96
2,689,602 A 9/1954 Morgan
3,351,376 A * 11/1967 Shimizu ..... A47C 9/105 297/16.2
4,520,835 A * 6/1985 Moeller ..... E04H 15/38 135/136
5,496,094 A * 3/1996 Schwartzkopf ..... A47C 4/48 248/164
5,676,293 A 10/1997 Farris
5,699,569 A * 12/1997 Schwarz-Zohrer .... A47D 9/005 5/655
6,401,404 B1 * 6/2002 Fillipp ..... B44C 5/00 40/538
6,592,012 B2 7/2003 Godshaw
7,118,172 B1 10/2006 Pattison-Sheets
9,049,916 B2 6/2015 Berei
9,468,284 B2 * 10/2016 Wehner ..... A47C 4/18
10,070,712 B2 9/2018 Wronski
(Continued)

FOREIGN PATENT DOCUMENTS

CN 105857378 A * 8/2016 ..... B62B 9/00
CN 114652134 A * 6/2022 ..... A47D 1/02

*Primary Examiner* — Timothy J Brindley

(57) ABSTRACT

A canopied folding chair assembly for shading a user includes a base to which a pod is mounted. The base includes a plurality of supports, the supports of which are pivotally coupled to each other so that the base is positionable in deployed and stored positions wherein the supports are angled outwardly with respect to each other and collapsed against each other, respectively. The pod comprises a plurality of ribs to which is attached a panel. The ribs are pivotable to arrayed and stowed positions in which the ribs are spaced from each other and nested, respectively. The panel comprises flexible material that forms a shell when the ribs are arrayed. The shell has an open front side to allow access the shell. Respective ribs are pivotable to move a top wall toward a rear wall of the shell so that the shell has an open top side.

13 Claims, 13 Drawing Sheets

(56) References Cited

U.S. PATENT DOCUMENTS

| | | | | |
|---|---|---|---|---|
| 10,130,180 | B2 | 11/2018 | Frankel | |
| 10,384,705 | B1 * | 8/2019 | Baptichon | B62B 9/20 |
| 10,426,270 | B2 * | 10/2019 | Beaulieu | A47C 7/66 |
| 10,631,647 | B1 * | 4/2020 | Wu | A45F 3/24 |
| D899,112 | S * | 10/2020 | Wehner | D6/344 |
| D917,908 | S | 5/2021 | Wehner | |
| D933,978 | S | 10/2021 | Wehner | |
| D944,024 | S | 2/2022 | Wehner | |
| 11,889,930 | B1 * | 2/2024 | Bastien | A47D 13/102 |
| 12,114,788 | B2 * | 10/2024 | Miller | A47D 13/107 |
| 2003/0020317 | A1 * | 1/2003 | Keegan | A47D 9/012 297/446.2 |
| 2004/0131801 | A1 * | 7/2004 | Wong | A01K 1/033 428/12 |
| 2005/0054486 | A1 * | 3/2005 | Turner | A47D 13/107 482/28 |
| 2007/0062995 | A1 | 3/2007 | Kasuli | |
| 2008/0203774 | A1 * | 8/2008 | Hemetsberger | A47C 7/666 297/16.2 |
| 2012/0042920 | A1 * | 2/2012 | Armstrong | E04H 15/003 135/153 |

* cited by examiner

CANOPIED FOLDING CHAIR ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to folding chairs and more particularly pertains to a new folding chair having an integral canopy for shading a user. Most folding chairs do not provide shade to a user seated therein and do not provide increased privacy for a user.

(2) Description of Related Art Including Information Disclosed Under 37 CFR 1.97 and 1.98

The prior art relates to folding chairs and in particular to folding chairs which can shade a user seated therein. While prior art folding chairs may allow for attachment of canopies or comprise deployable canopies, these solutions are often inadequate due to instability in windy conditions, inconsistent shading, operational difficulties, and the like. A pod type folding chair having an adjustable and integrated canopy would overcome these inadequacies.

BRIEF SUMMARY OF THE INVENTION

An embodiment of the disclosure meets the needs presented above by generally comprising a base to which a pod is mounted. The base is positionable on a ground surface and includes a plurality of supports, the supports of which are pivotally coupled to each other. The base is positionable in a deployed position and in a stored position. In the deployed position, the supports are angled outwardly with respect to each other whereas in the stored position the supports are collapsed against each other.

The pod comprises a plurality of ribs to which is attached a panel. Each rib has a first end and a second end. The first ends are pivotally coupled to each other and the second ends are pivotally coupled to each other so that the ribs are positionable in an arrayed position and in a stowed position. In the arrayed position, the ribs are spaced from each other whereas in a stowed position the ribs are nested and the plurality of ribs is nestable with the supports in the stored position.

The panel comprises flexible material and forms a shell when the ribs are in the arrayed position. The shell has an open front side to allow access the shell. The panel defines a top wall, a rear wall, a bottom wall, and a pair of lateral walls of the shell. Respective ribs are pivotable to move the top wall toward the rear wall so that the shell has an open top side.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
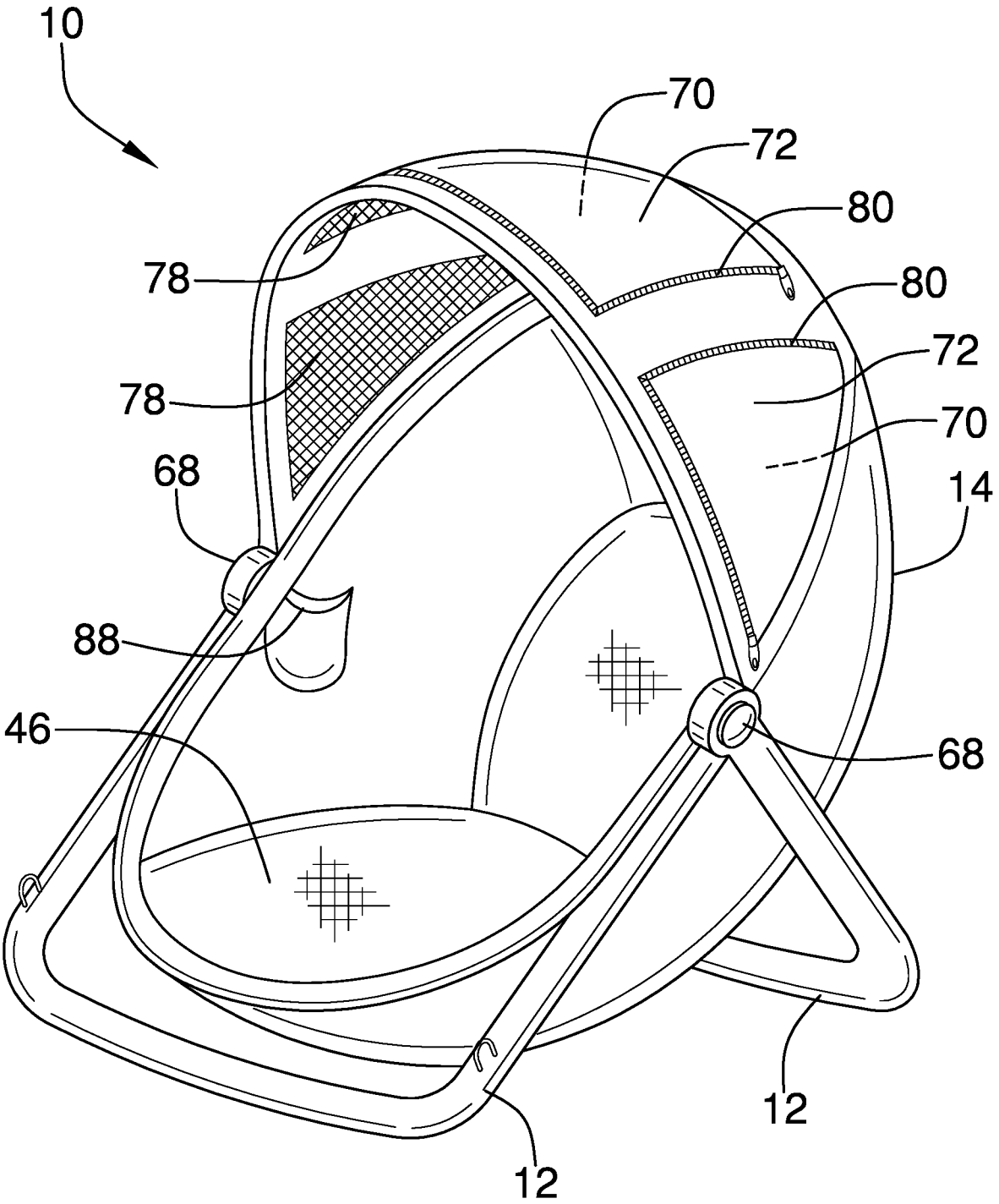
FIG. 1 is an isometric perspective view of a canopied folding chair assembly according to an embodiment of the disclosure.
Figure 2:
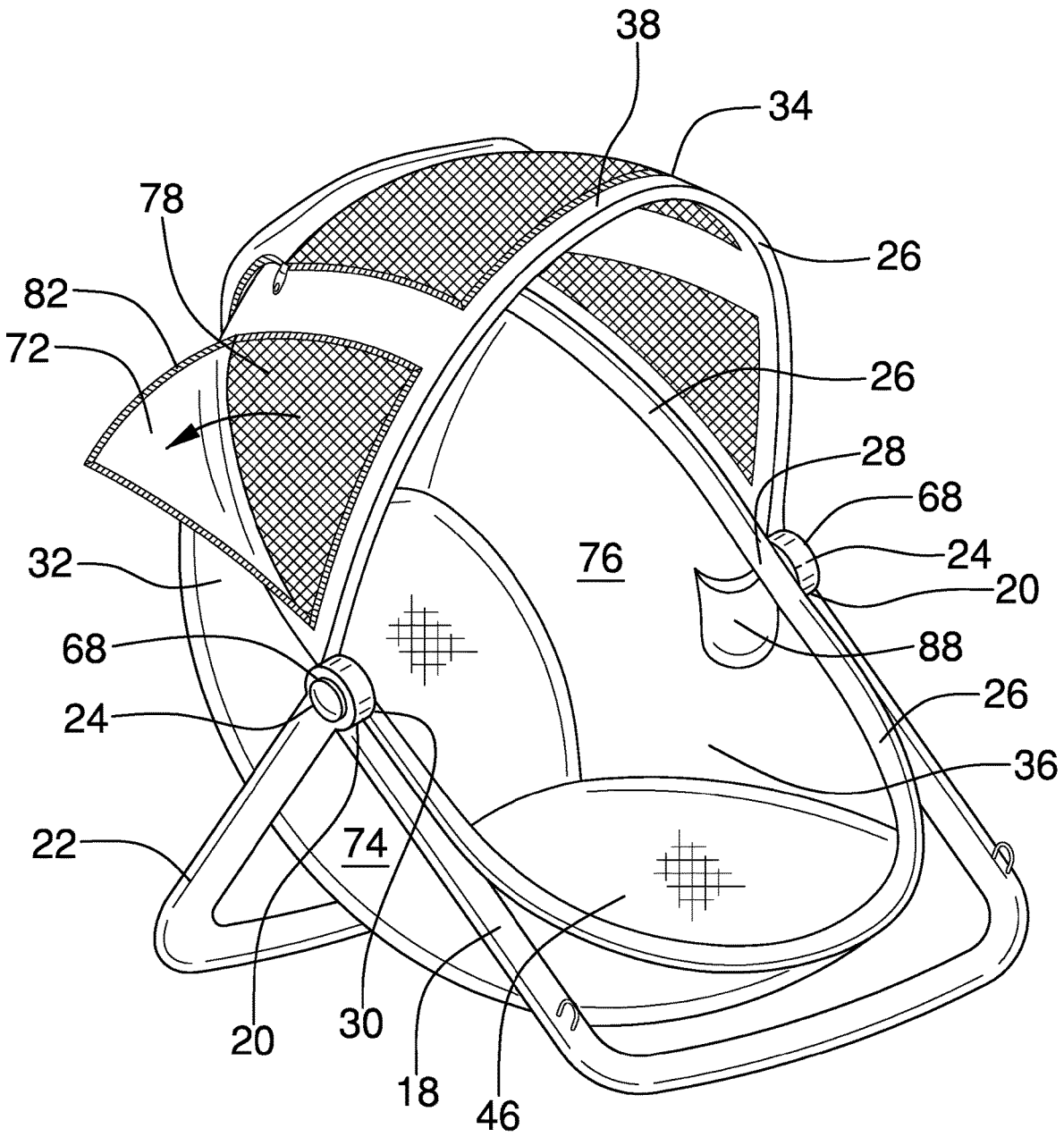
FIG. 2 is an isometric perspective view of an embodiment of the disclosure.
Figure 3:
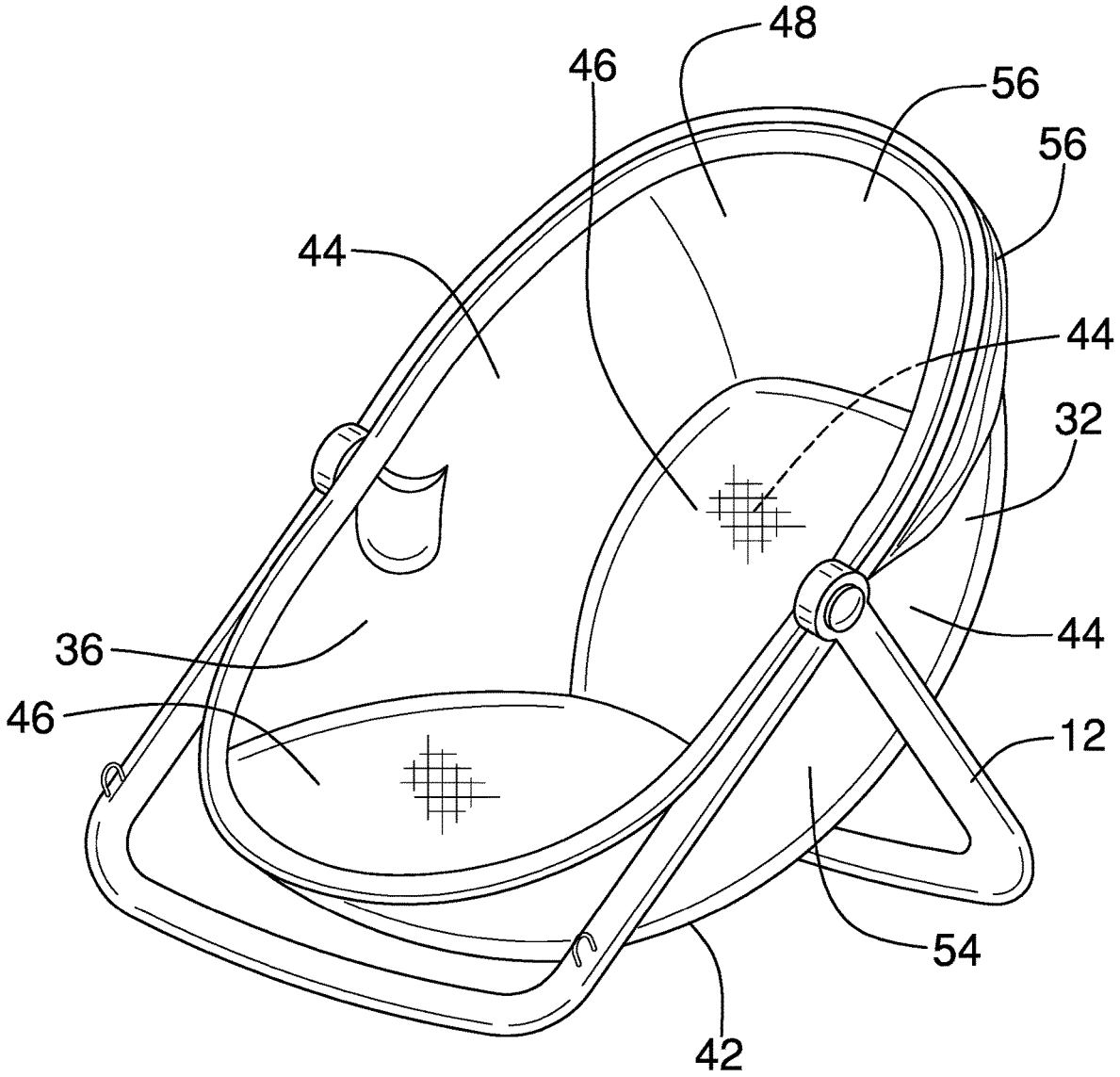
FIG. 3 is an isometric perspective view of an embodiment of the disclosure.
Figure 4:
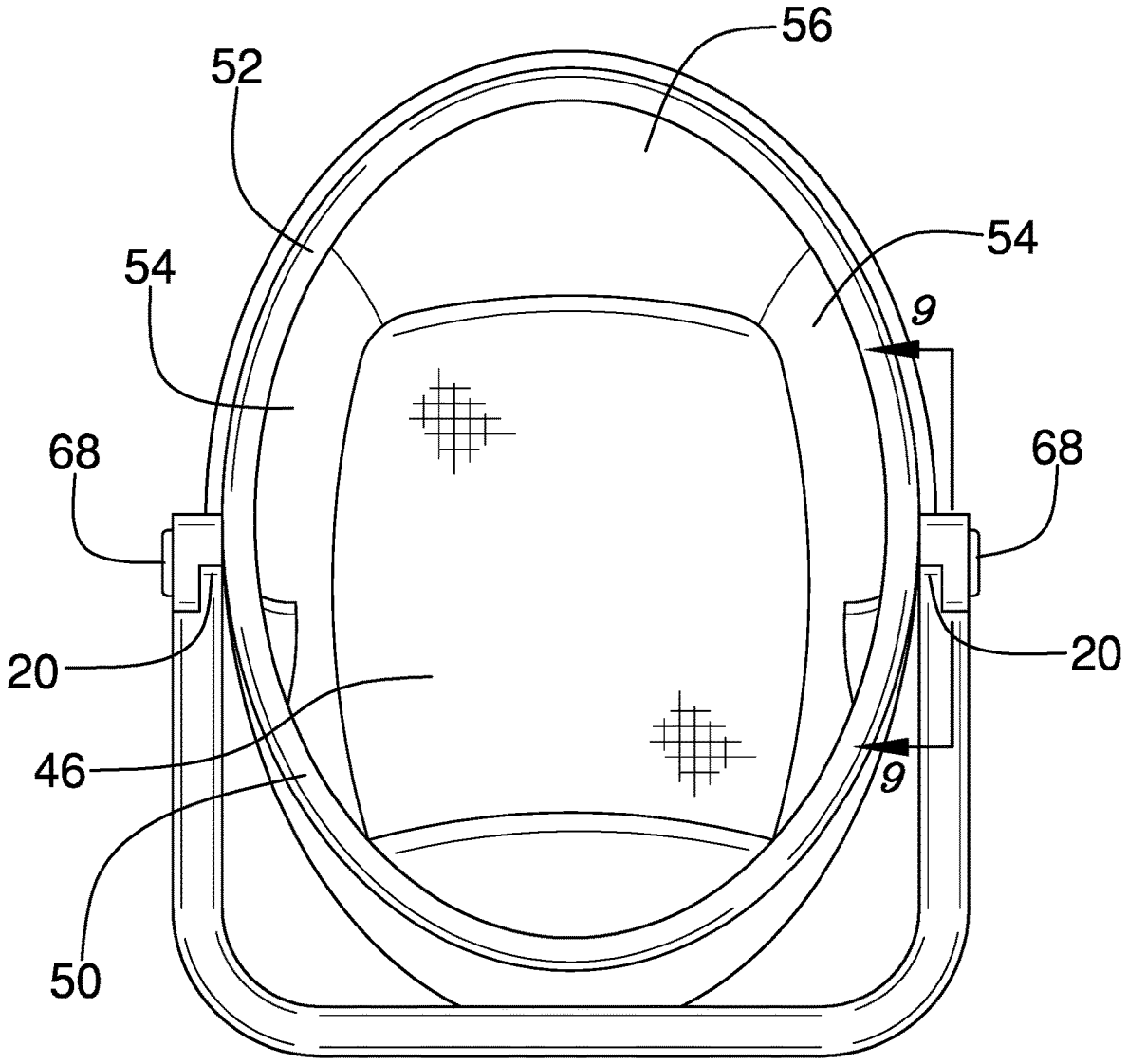
FIG. 4 is a front view of an embodiment of the disclosure.
Figure 5:
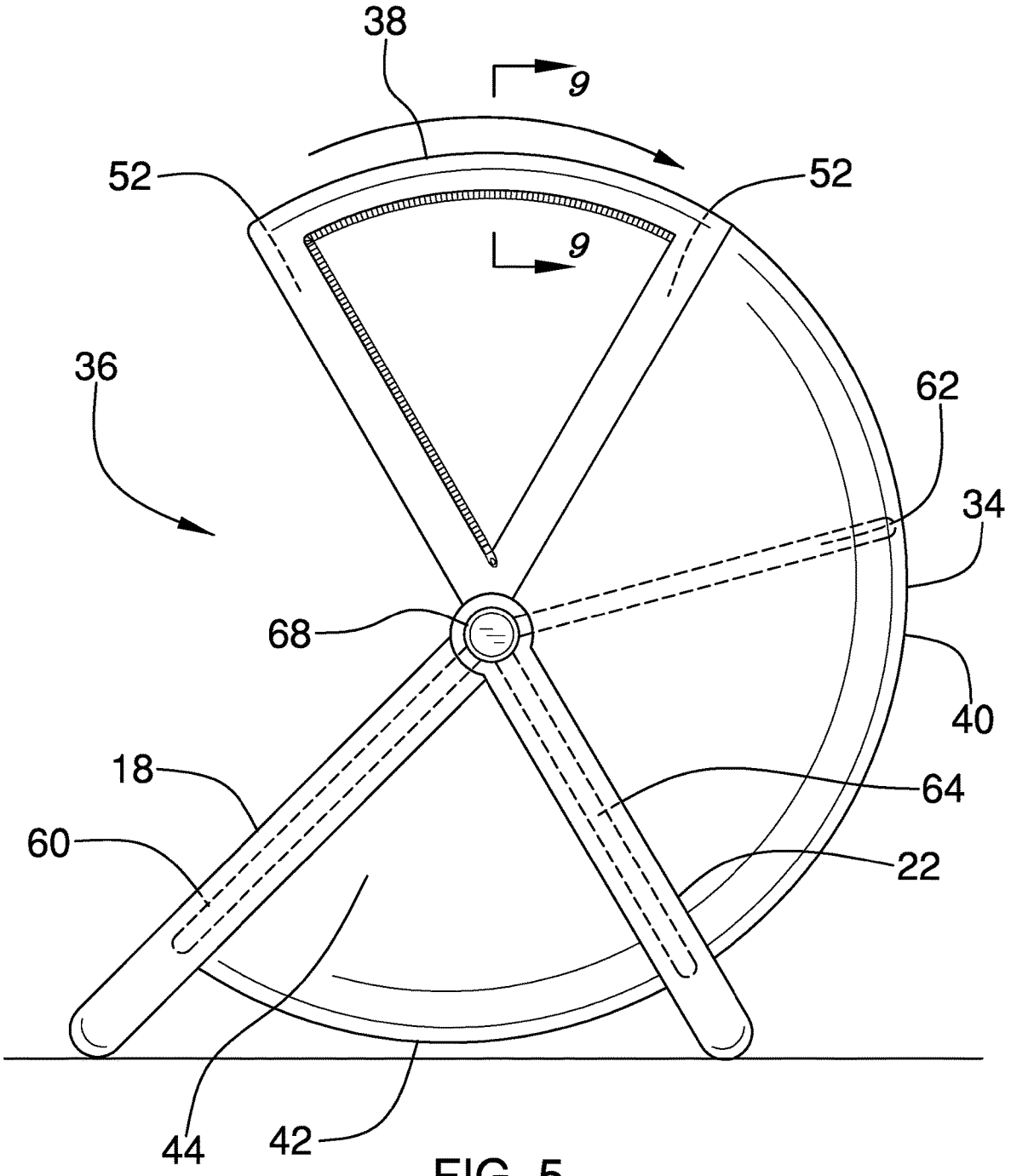
FIG. 5 is a side view of an embodiment of the disclosure.
Figure 6:
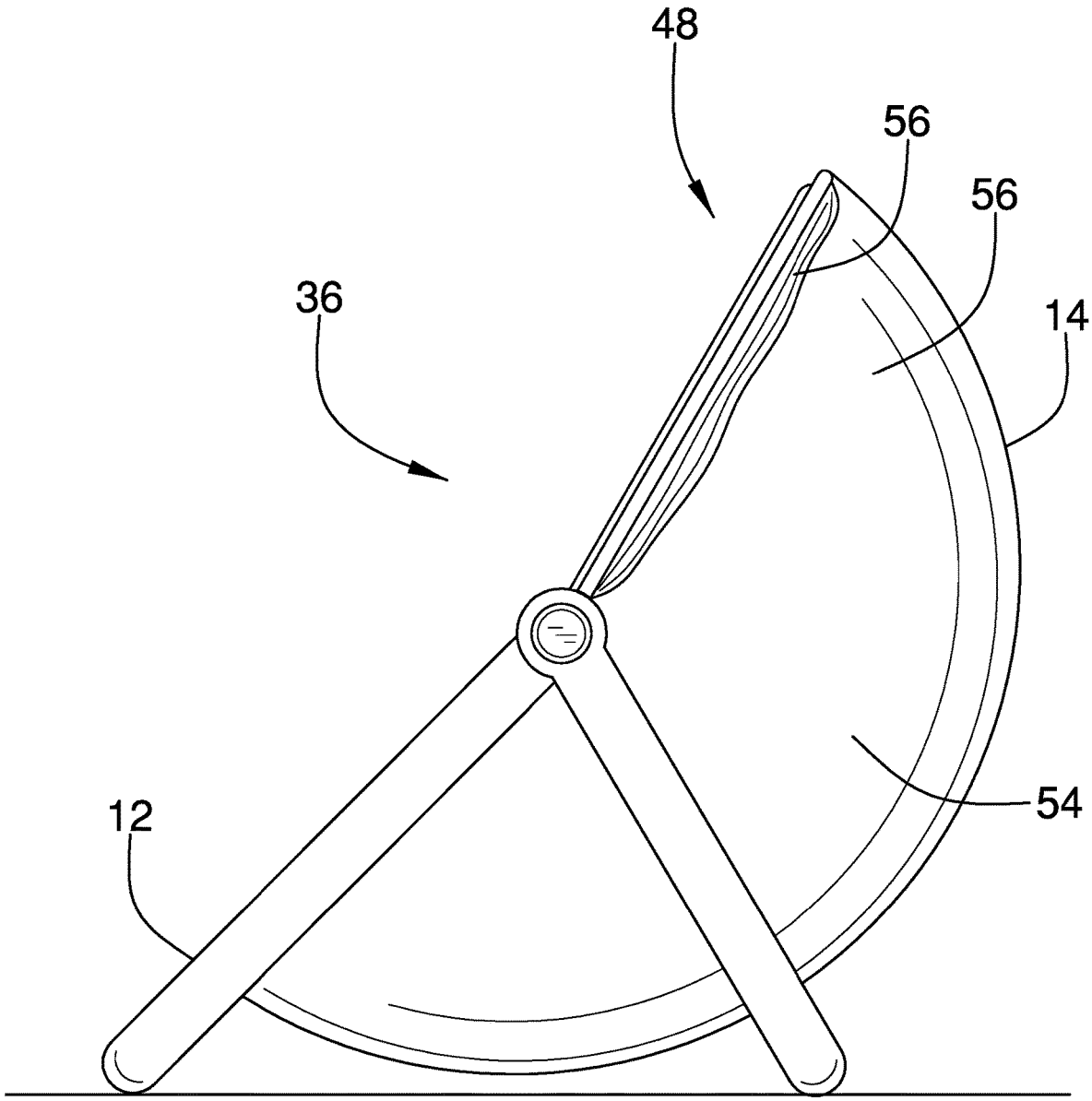
FIG. 6 is a side view of an embodiment of the disclosure.

With reference now to the drawings, and in particular to FIGS. 1 through 13 thereof, a new folding chair embodying the principles and concepts of an embodiment of the disclosure and generally designated by the reference numeral 10 will be described.

Figure 13:
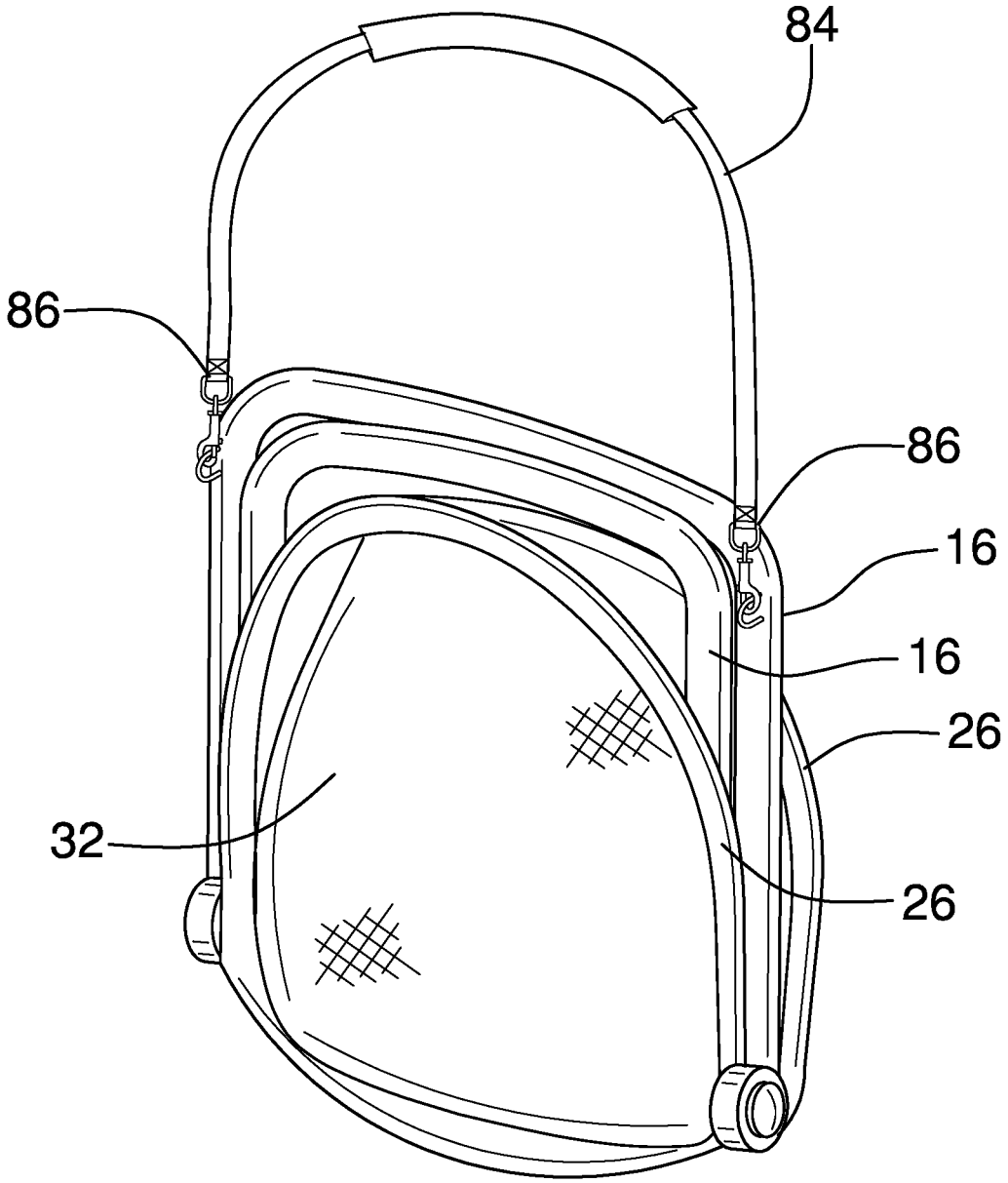
FIG. 13 is a collapsed view of an embodiment of the disclosure.

As best illustrated in FIGS. 1 through 13, the canopied folding chair assembly 10 generally comprises a base 12 to which a pod 14 is mounted. The base 12 is positionable on a ground surface and includes a plurality of supports 16. The supports 16 are pivotally coupled to each other so that the base 12 is positionable in a deployed position and in a stored position, as is shown in FIGS. 1 and 13, respectively. In the deployed position, the supports 16 are angled outwardly with respect to each other whereas in the stored position the supports 16 are collapsed against each other. As is shown in the figures, the plurality of supports 16 comprises a front member 18 having opposite ends 20 and a rear member 22 having opposed ends 24. The front member 18 and the rear member 22 each have a flattened C shape. Each of the opposed ends 24 of the rear member 22 is pivotally attached to a respective opposite end 20 of the front member 18 so that the base 12 is selectively deployable by pivoting of the rear member 22 relative to the front member 18.

Other configurations of the base 12 will be obvious to those skilled in the art of folding chairs and these are anticipated by the present invention. The present invention anticipates pivoting of the rear member 22 relative to the front member 18 being limited to orient the rear member 22 and the front member 18 in an optimal stabilizing relationship. The present invention also anticipates the rear member 22 being reversibly fastenable to the front member 18 to secure the base 12 in the deployed position at the optimal stabilizing relationship.

The base 12 and the pod 14 are structured and sized to seat and to support a user having a mass of between 45.0 kg and 118.0 kg and a height of between 62.0 inches and 88.0 inches. The pod 14 comprises a plurality of ribs 26 to which is attached a panel 32. Each rib 26 has a first end 28 and a second end 30. The first ends 28 are pivotally coupled to each other and the second ends 30 are pivotally coupled to each other so that the ribs 26 are positionable in an arrayed position and in a stowed position, as is shown in FIGS. 1 and 13, respectively. In the arrayed position, the ribs 26 are spaced from each other whereas in a stowed position the ribs 26 are nested and the plurality of ribs 26 is nestable with the supports 16 in the stored position. Typically, the rear member 22, the front member 18, and the ribs 26 would be tubular and would comprise metal, such as aluminum, titanium, steel, or the like.

The panel 32 comprises flexible material and forms a shell 34 when the ribs 26 are in the arrayed position. The shell 34 has an open front side 36 to allow access to the shell 34. The panel 32 defines a top wall 38, a rear wall 40, a bottom wall 42, and a pair of lateral walls 44 of the shell 34. A pad 46 is positioned in the shell 34 and substantially covers the bottom wall 42 and the rear wall 40. Respective ribs 26 are pivotable to move the top wall 38 toward the rear wall 40 so that the shell 34 has an open top side 48. The ribs 26 typically are arcuate so that the shell 34 has a partially spherical shape. The present invention also anticipate the ribs 26 being alternatively shaped, such as flattened C-shaped, so that the sphere is alternatively shaped, such as having a partial polyhedral shape.

Figure 7:
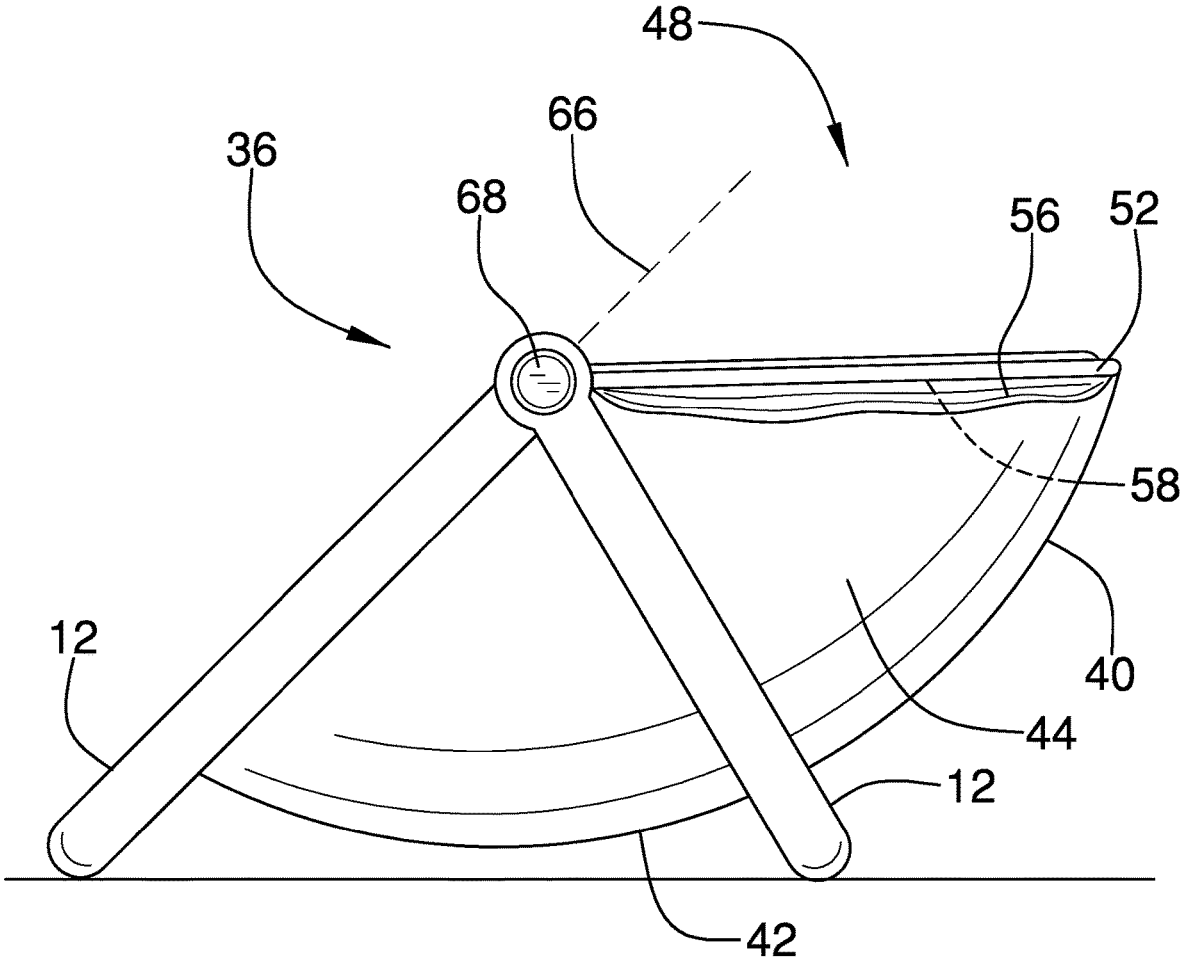
FIG. 7 is a side view of an embodiment of the disclosure.
Figure 8:
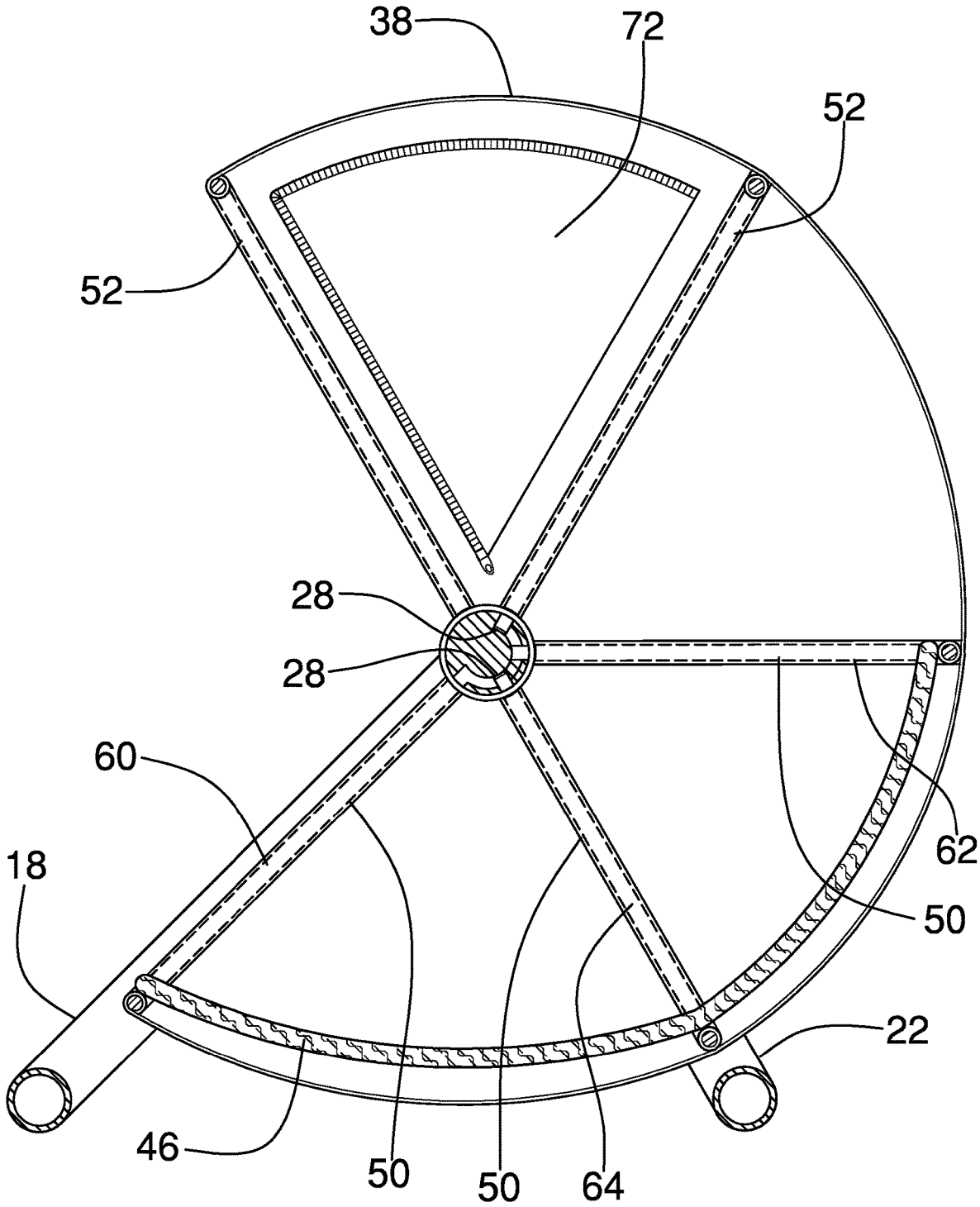
FIG. 8 is a cross-sectional view of an embodiment of the disclosure.

The plurality of ribs 26 may comprise a plurality of seat rods 50 and a set of canopy rods 52. A first section 54 of the panel 32 is attached to the plurality of seat rods 50. A second section 56 of the panel 32 is attached to an upper limit 58 of the plurality of seat rods 50 and to the set of canopy rods 52. The canopy rods 52 are pivotable to move the top wall 38 toward the rear wall 40 so that the shell 34 has the open top side 48, as is shown in FIG. 7.

The plurality of seat rods 50 may comprise a fixed rod 60, which is fixedly attached to the front member 18, a leading rod 62, and a set of medial rods 64. With the plurality of ribs 26 being in the arrayed position, the leading rod 62 extends downwardly from a plane 66 that is defined by the fixed rod 60 by from 1.0 to 22.0°. The first section 54 of the panel 32 is attached to the fixed rod 60, the leading rod 62, and the set of medial rods 64 so that the first section 54 is taut with the ribs 26 are in the arrayed position. The panel 32 thus is configured to support the user in a seated position within the pod 14. The panel 32 is anticipated to comprise meshed fabric, thereby allowing for airflow through the pod 14 to keep the user cool and comfortable on warm days.

Figure 9:
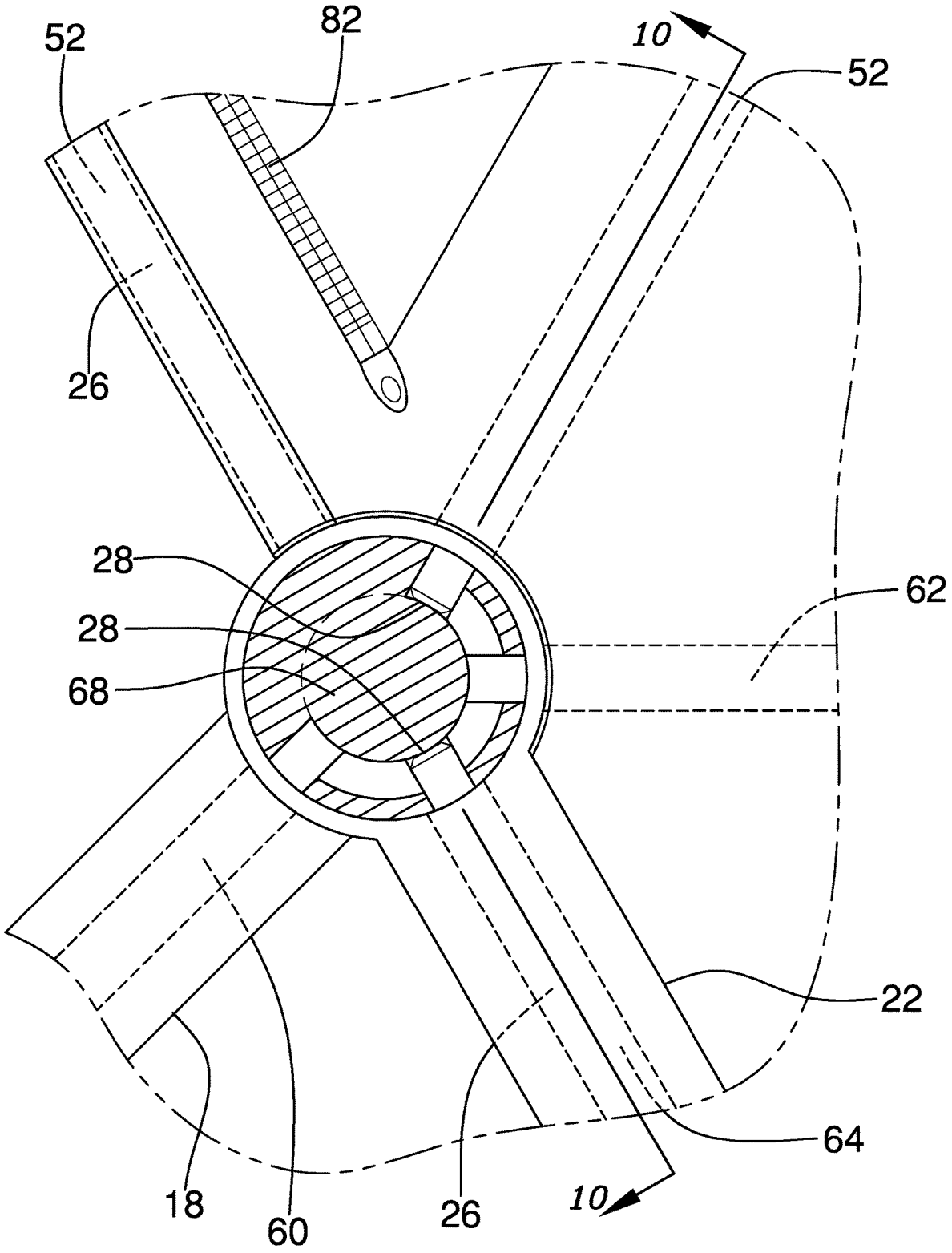
FIG. 9 is a cross-sectional view of an embodiment of the disclosure.
Figure 10:
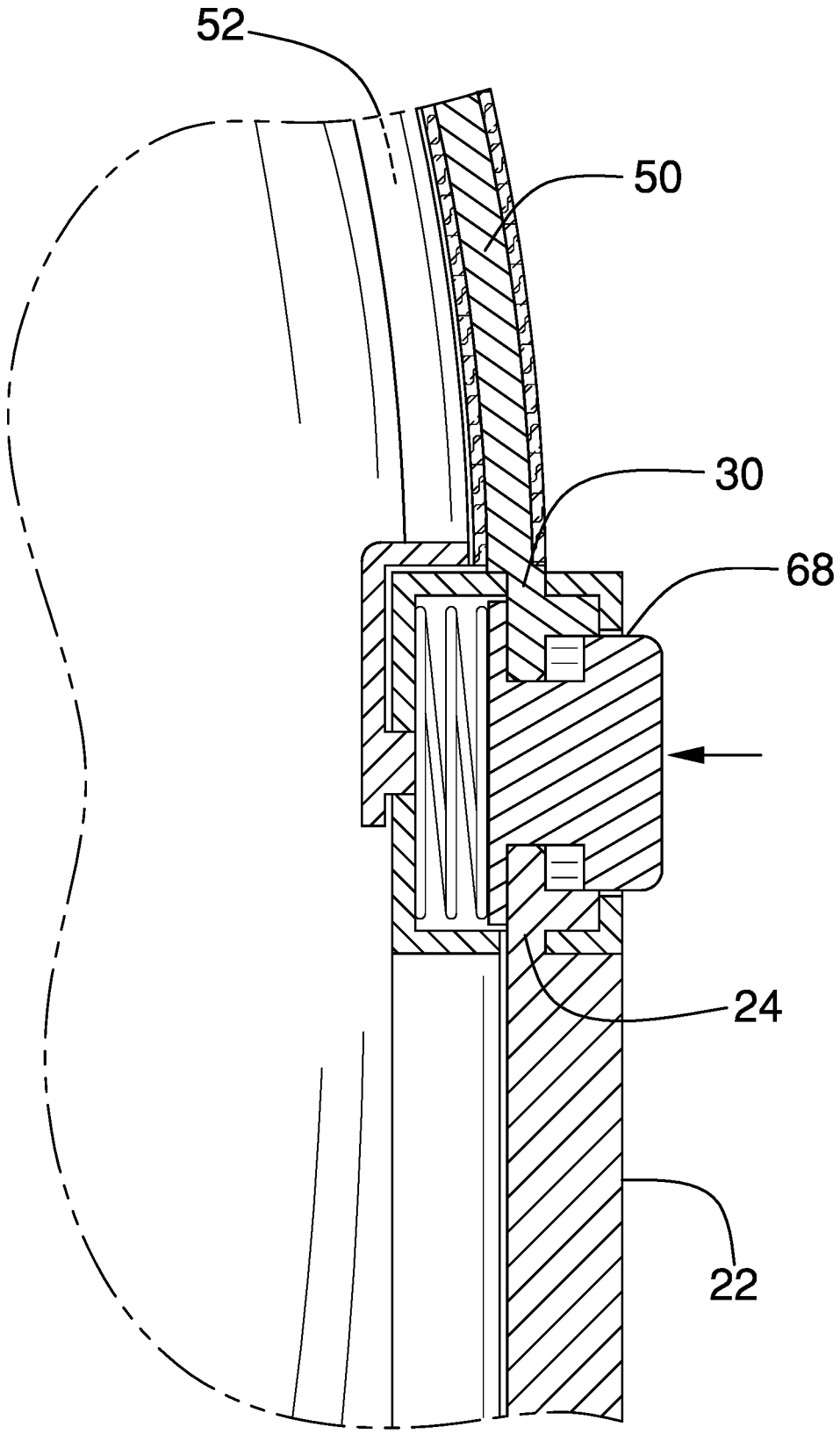
FIG. 10 is a cross-sectional view of an embodiment of the disclosure.
Figure 11:
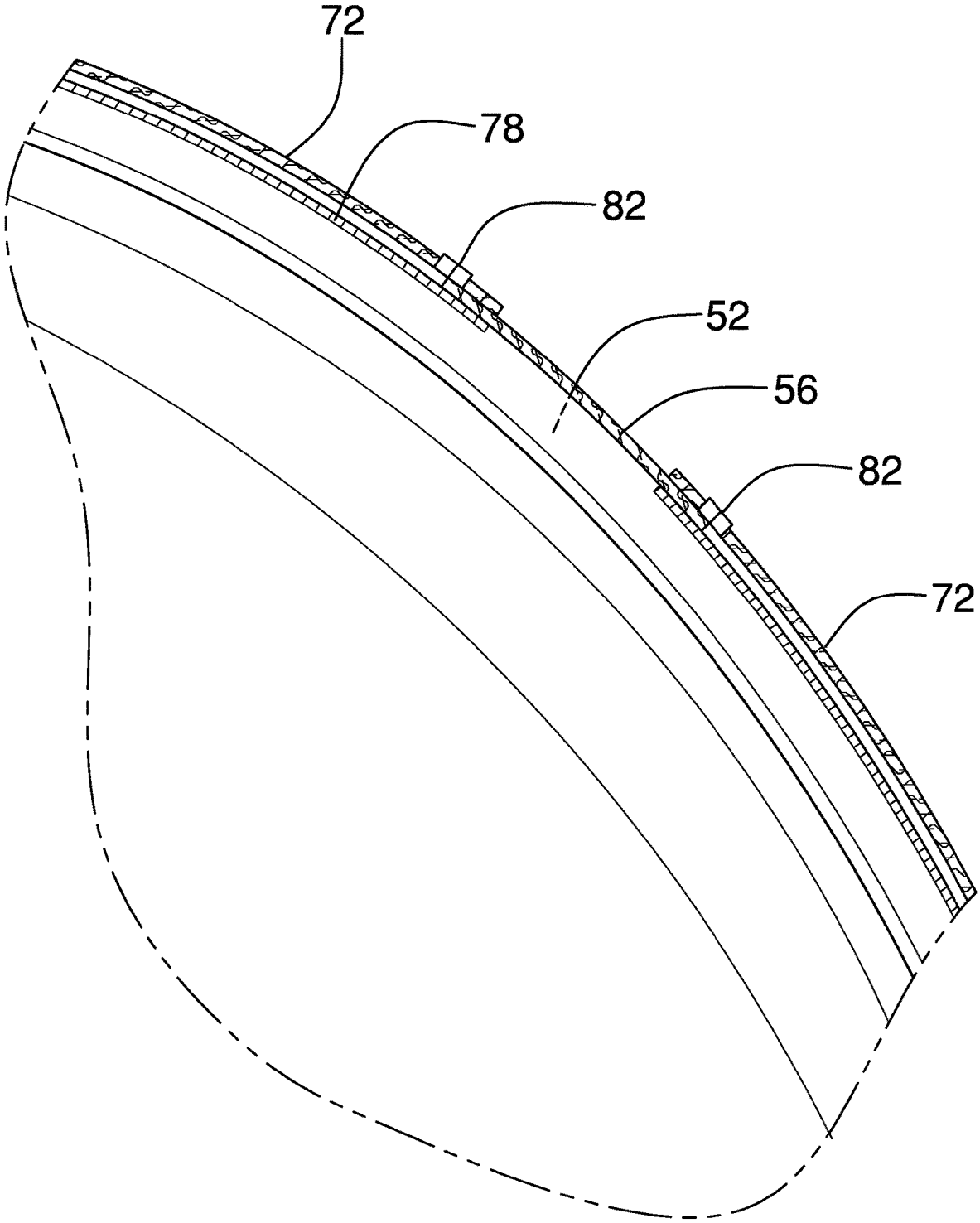
FIG. 11 is a cross-sectional view of an embodiment of the disclosure.
Figure 12:
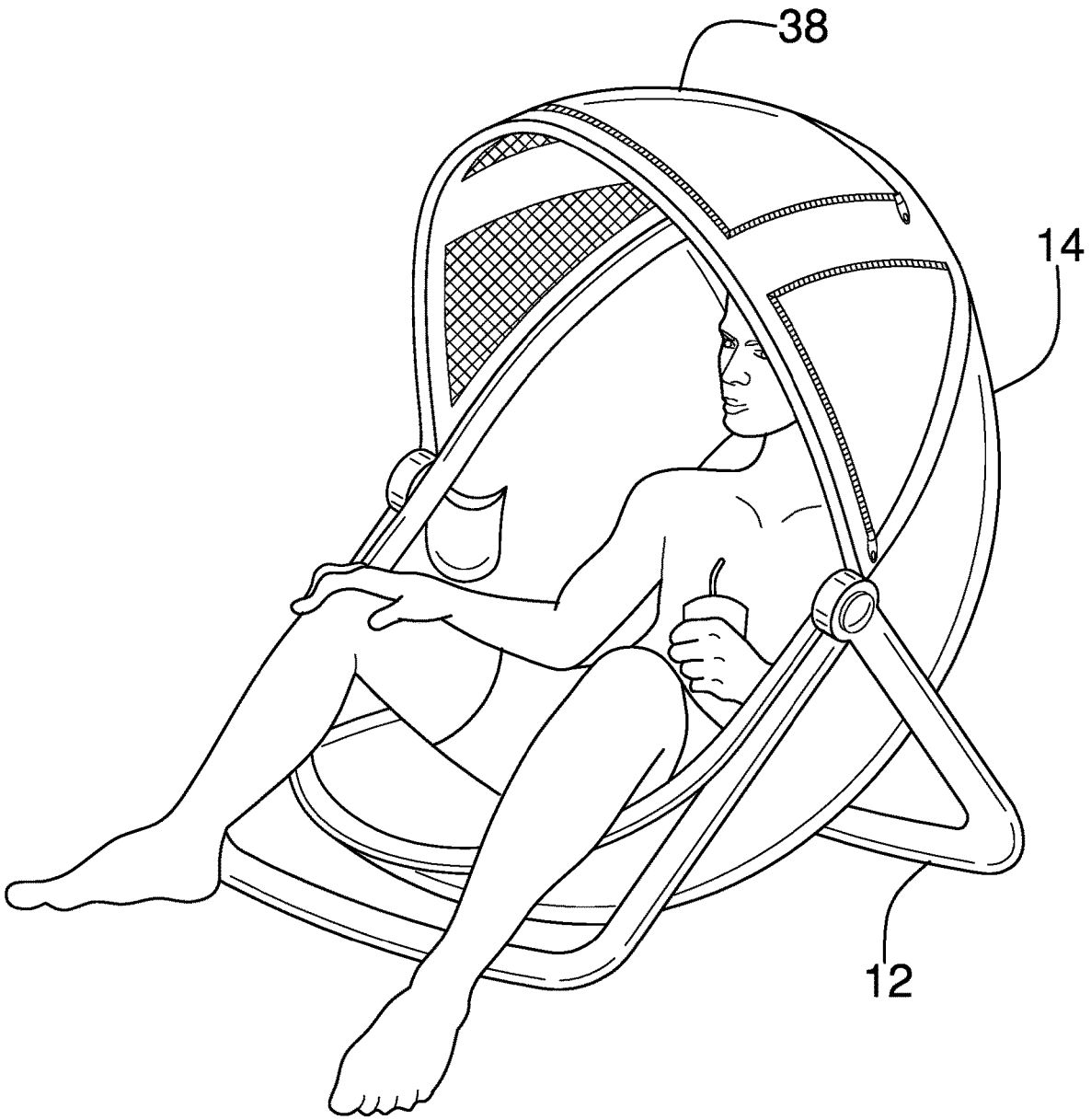
FIG. 12 is an in-use view of an embodiment of the disclosure.

A pair of locks 68 is attached singly to the opposes ends 24 of the rear member 22. Each lock 68 is selectively attachable to the front member 18 to secure the base 12 in the deployed position. One lock 68 is selectively attachable to first ends 28 of the seat rods 50 and the other lock 68 is selectively attachable to the second ends 30 of the seat rods 50 to secure the seat rods 50 in the arrayed position. The locks 68 may be spring-loaded cam-type locks, as is shown in FIGS. 9 and 10, or other type of lock known to those skilled in the art of folding chairs.

The second section 56 of the panel 32 may have a set of window openings 70 positioned therein. Each flap 72 of a set of flaps 72 is attached to the second section 56 of the panel 32 proximate to a respective window opening 70 so that the window opening 70 is selectively coverable by the flap 72. As is shown in the figures, the flaps 72 are attached to an exterior surface 74 of the panel 32. The present invention also anticipates the flaps 72 being attached to an interior surface 76 of the panel 32 and thus readily accessible to the user while seated within the pod 14. Each meshed fabric section 78 of a set of meshed fabric sections 78 is attached the second section 56 of the panel 32 and extends over a respective window opening 70 so that the respective window opening 70 is screened. The window openings 70 being screened provides visibility for the user while maintaining their privacy.

Each closure 80 of a set of closures 80 is attached to the second section 56 of the panel 32 proximate to a respective window opening 70 and is selectively attachable to a respective flap 72 to secure the respective flap 72 over the respective window opening 70. As is shown in the figures, each closure 80 may comprise a zipper 82, or other closing means, such as, but not limited to, hook and loop fasteners, buttons, snaps, or the like.

The canopied folding chair assembly 10 also may include a strap 84 having opposing ends 86. The opposing ends 86 are attached to the base 12 for carrying of the base 12 and the pod 14 with the base 12 being in the stored position and the plurality of ribs 26 being positioned in the stowed position. As is shown in the figures, the canopied folding chair assembly 10 also may include a plurality of pockets 88, with the pockets 88 being attached to the interior surface 76 of the panel 32 and accessible to the user for stowing personal items, such as a phone, sunglasses, a drink, or the like.

In use, the rear member 22 is pivoted relative to the front member 18 so that the base 12 is positioned in the deployed position and is positionable on a ground surface, such as a lawn, a beach, a boat deck, or the like. The ribs 26 then are pivoted to the arrayed position to draw the panel 32 taut. A user then can enter the shell 34 via the open front side 36 and selectively move the canopy rods 52 so that the shell 34 has an open top side 48. The present invention is anticipated to enable the user to enjoy outdoor spaces in solitude and peace, as may be preferred for a user desiring less social interaction or who has sensory issues. The pod 14 provides shelter from sun, wind, and rain while providing substantially unobstructed views and a degree of privacy. The canopied folding chair assembly 10 being collapsible renders it both portable and readily stowable.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A canopied folding chair assembly comprising:

a base positionable on a ground surface and including a plurality of supports being pivotally coupled to each other, the base being positionable in a deployed position with the supports being angled outwardly with respect to each other and in a stored position with the supports being collapsed against each other;

a pod mounted to the base, the pod comprising:

a plurality of ribs each having a first end and a second end, the first ends being pivotally coupled to each other and the second ends being pivotally coupled to each other such that the ribs are positionable in an arrayed position wherein the ribs are spaced from each other and in a stowed position wherein the ribs are nested and the plurality of ribs is nestable with the plurality of supports in the stored position; and a panel being attached to the plurality ribs, the panel comprising flexible material and forming a shell when the ribs are in the arrayed position, the shell having an open front side to access the shell, the panel defining a top wall, a rear wall, a bottom wall, and a pair of lateral walls of the shell, wherein respective ribs are pivotable to move the top wall toward the rear wall such that the shell has an open top side; and wherein the plurality of supports comprises:

a front member having opposite ends, the front member having a flattened C-shape; and a rear member having opposed ends, the rear member having a flattened C-shape, each of the opposed ends being pivotally attached to a respective opposite end of the front member such that the base is selectively deployable by pivoting of the rear member relative to the front member.

2. The canopied folding chair assembly of claim 1, wherein the rear member, the front member, and the plurality of ribs are tubular.

3. The canopied folding chair assembly of claim 1, wherein the rear member, the front member, and the plurality of ribs comprise metal.

4. The canopied folding chair assembly of claim 1, wherein the ribs are arcuate such that the shell has a partially spherical shape.

5. The canopied folding chair assembly of claim 1, wherein:

the plurality of ribs comprises:

a plurality of seat rods; and a set of canopy rods being pivotable to move the top wall toward the rear wall such that the shell has the open top side; and the panel comprises:

a first section being attached to the plurality of seat rods; and a second section being attached to an upper limit of the plurality of seat rods and to the canopy rods of the set of canopy rods.

6. The canopied folding chair assembly of claim 5, wherein the plurality of seat rods comprises:

a fixed rod being fixedly attached to the front member, the first section of the panel being attached to the fixed rod;

a leading support, the leading support with the plurality of ribs being in the arrayed position extending downwardly from a plane defined by the fixed rod by from 1.0 to 22.0°, the first section of the panel being attached to the leading support; and a set of medial rods, the first section of the panel being attached to the set of medial rods such that the first section of the panel is taut with the plurality of ribs being in the arrayed position, wherein the panel is configured for supporting the user in a seated position.

7. The canopied folding chair assembly of claim 6, further including a pair of locks being attached singly to the opposed ends of the rear member, each lock being selectively attachable to the front member for securing the base in the deployed position, one lock being selectively attachable to first ends of the seat rods and the other lock being selectively attachable to the second ends of the seat rods to secure the seat rods in the arrayed position.

8. The canopied folding chair assembly of claim 1, further including a pad being positioned in the shell and substantially covering the bottom wall and the rear wall.

9. The canopied folding chair assembly of claim 1, wherein the base and the pod are structured and sized for seating and supporting a user having a mass of between 45.0 kg and 118.0 kg and a height of between 62.0 inches and 88.0 inches.

10. The canopied folding chair assembly of claim 5, further including:

the second section of the panel having a set of window openings positioned therein; and a set of flaps, each flap being attached to the second section of the panel proximate to a respective window opening such that the window opening is selectively coverable by the flap.

11. The canopied folding chair assembly of claim 10, further including a set of closures, each closure being attached to the second section of the panel proximate to a respective window opening and being selectively attachable to a respective flap for securing the respective flap over the respective window opening.

12. The canopied folding chair assembly of claim 10, further including a set of meshed fabric sections, each meshed fabric section being attached to the second section of the panel and extending over a respective window opening such that the respective window opening is screened.

13. The canopied folding chair assembly of claim 1, further including a strap having opposing ends, the opposed ends being attached to the base for carrying the base and the pod with the base being in the stored position and the plurality of ribs being positioned in the stowed position.

* * * * *